US006814430B2

(12) United States Patent
Cox et al.

(10) Patent No.: US 6,814,430 B2
(45) Date of Patent: Nov. 9, 2004

(54) FLUID CONTROLLING APPARATUS

(75) Inventors: Julie J. Cox, Albany, OR (US); John A. Compton, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/442,490

(22) Filed: May 21, 2003

(65) Prior Publication Data

US 2003/0231228 A1 Dec. 18, 2003

Related U.S. Application Data

(63) Continuation of application No. 10/174,098, filed on Jun. 18, 2002, now Pat. No. 6,607,264.

(51) Int. Cl.[7] ..... B41J 2/05
(52) U.S. Cl. ..... 347/64
(58) Field of Search ..... 347/63, 64

(56) References Cited

U.S. PATENT DOCUMENTS

| | | | | |
|---|---|---|---|---|
| 4,596,994 | A | 6/1986 | Matsuda et al. | |
| 4,719,477 | A | 1/1988 | Hess | |
| 5,187,500 | A | 2/1993 | Bohorquez et al. | |
| 5,682,188 | A | 10/1997 | Meyer et al. | |
| 6,012,804 | A | 1/2000 | Mitani | |
| 6,139,131 | A | 10/2000 | Prasad et al. | |
| 6,155,674 | A | 12/2000 | Figueredo et al. | |
| 6,395,148 | B1 | 5/2002 | Whitman | |
| 6,607,264 | B1 * | 8/2003 | Cox et al. | 347/64 |

FOREIGN PATENT DOCUMENTS

| | | |
|---|---|---|
| DE | 3416-059 | 10/1984 |
| EP | 0229673 | 7/1987 |
| EP | 0863006 | 9/1998 |
| EP | 1177899 | 2/2002 |
| JP | 59-194866 | 11/1984 |
| JP | 60-159060 | 8/1985 |
| JP | 62-169660 | 7/1987 |
| JP | 4-78539 | 3/1992 |
| JP | 4-255357 | 9/1992 |
| JP | 5-155023 | 6/1993 |
| WO | WO90/13428 | 11/1990 |

OTHER PUBLICATIONS

EP Search Report 03253493.4–1251—dated Apr. 28, 2004.

* cited by examiner

*Primary Examiner*—Michael S. Brooke

(57) ABSTRACT

A fluid controlling apparatus having a multi-layer structure that includes a top layer having a yield strength of less than about 500 megapascals, a middle layer having a yield strength of greater than about 1000 megapascals, and a bottom layer having a yield strength of less than about 500 megapascals.

22 Claims, 2 Drawing Sheets

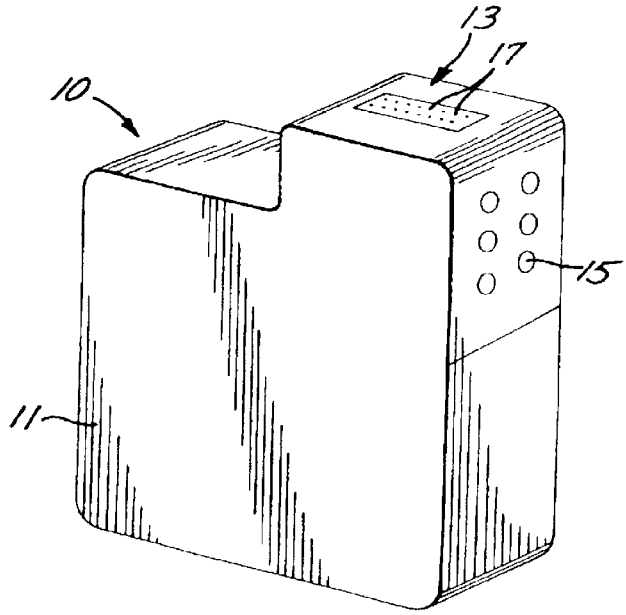
FIG. 1
FIG. 3
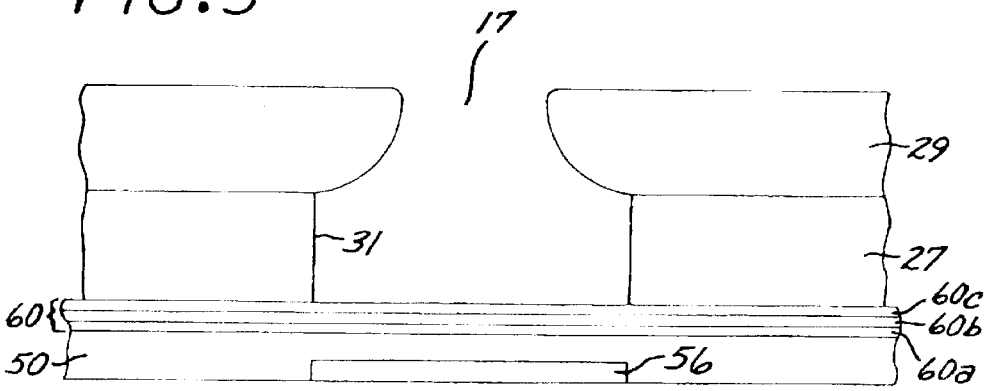

FLUID CONTROLLING APPARATUS

This application is a continuation of Ser. No. 10/174,098 filed Jun. 18, 2002 now U.S. Pat. No. 6,607,264.

BACKGROUND OF THE DISCLOSURE

The art of ink jet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the *Hewlett-Packard Journal*, Vol. 36, No. 5 (May 1985); Vol. 39, No. 5 (Oct. 1988); Vol. 43, No. 4 (Aug. 1992); Vol. 43, No. 6 (Dec. 1992); and Vol. 45, No. 1 (Feb. 1994).

Generally, an ink jet image is formed pursuant to precise placement on a print medium of ink drops emitted by an ink drop generating device known as an ink jet printhead. For example, an ink jet printhead is attached to a print cartridge body that is, for example, supported on a movable print carriage that traverses over the surface of the print medium. The ink jet printhead is controlled to eject drops of ink at appropriate times pursuant to command of a microcomputer or other controller, wherein the timing of the application of the ink drops is intended to correspond to a pattern of pixels of the image being printed.

A typical Hewlett-Packard ink jet printhead includes an array of precisely formed nozzles in an orifice structure that is attached to or integral with an ink barrier structure that in turn is attached to a thin film substructure that implements ink firing heater resistors and apparatus for enabling the resistors. The ink barrier structure can define ink flow control structures, particle filtering structures, ink passageways or channels, and ink chambers. The ink chambers are disposed over associated ink firing resistors, and the nozzles in the orifice structure are aligned with associated ink chambers. Ink drop generator regions are formed by the ink chambers and portions of the thin film substructure and the orifice structure that are adjacent the ink chambers. To emit an ink drop, a selected heater resistor is energized with electric current. The heater resistor produces heat that heats ink liquid in the adjacent ink chamber. When the liquid in the chamber reaches vaporization, a rapidly expanding vapor front or drive bubble forces liquid within the ink chamber through an adjacent orifice.

A consideration with a printhead that employs heater resistors is reducing damage resulting from cavitation pressure of a collapsing drive bubble.

BRIEF DESCRIPTION OF THE DRAWINGS

The advantages and features of the disclosed invention will readily be appreciated by persons skilled in the art from the following detailed description when read in conjunction with the drawing wherein:

FIG. 1 is schematic perspective view of an embodiment of a print cartridge that can incorporate a disclosed drop emitting device.

FIG. 3 is a schematic cross-sectional view of an embodiment of a portion of the fluid drop emitting of FIG. 2 depicting examples of major components of a thin film stack thereof.

DETAILED DESCRIPTION OF THE DISCLOSURE

Figure 2:
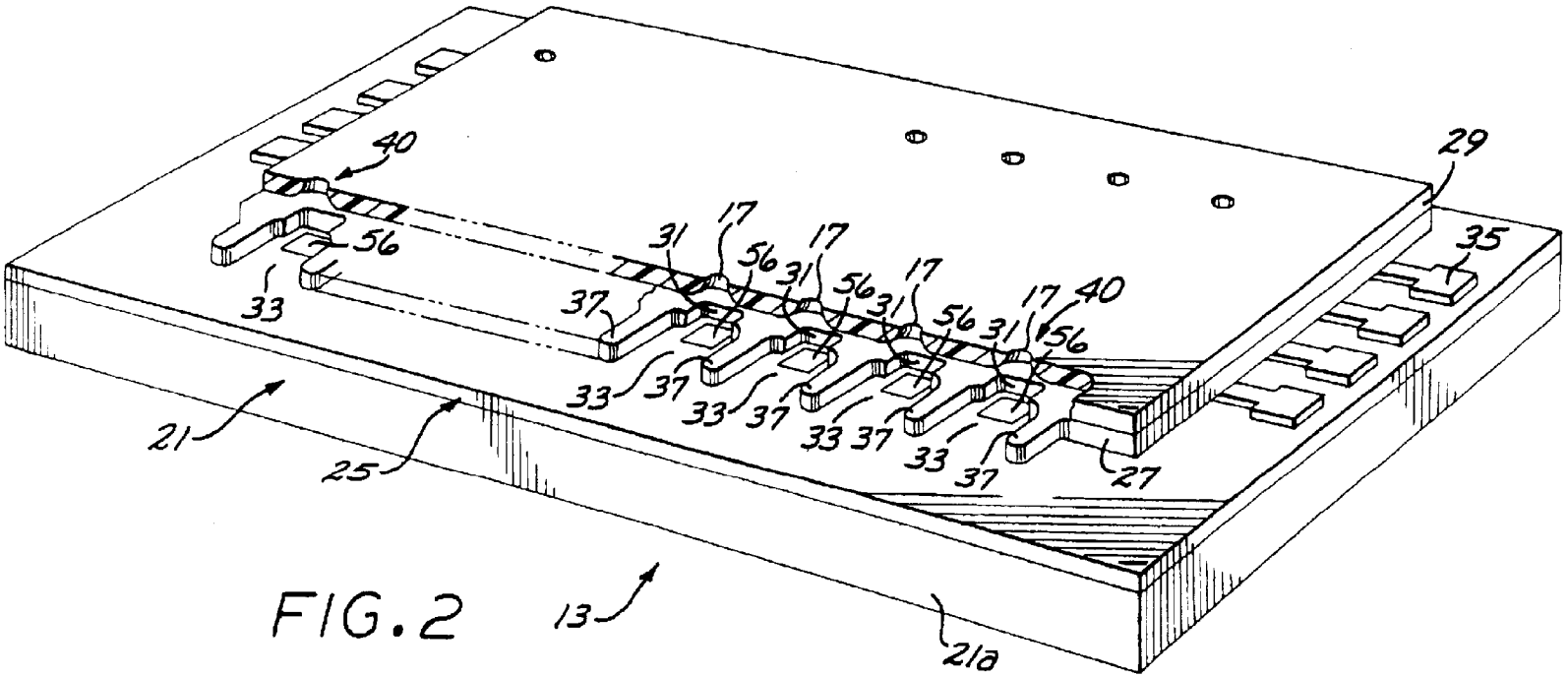
FIG. 2 is a schematic perspective view of an example of an embodiment of a fluid drop emitting device that embodies principles disclosed in the specification.

FIG. 1 is a schematic perspective view of an embodiment of one type of ink jet print cartridge 10 that can incorporate the disclosed fluid drop emitting apparatus that by way of illustrative example is disclosed as a fluid drop jetting printhead. The print cartridge 10 includes a cartridge body 11, a printhead 13, and electrical contacts 15. The cartridge body 11 contains ink or other suitable fluid that is supplied to the printhead 13, and electrical signals are provided to the contacts 15 to individually energize fluid drop generators to eject a droplet of fluid from a selected nozzle 17. The print cartridge 10 can be a disposable type that contains a substantial quantity of fluid such as ink within its body 11. Another suitable print cartridge may be of the type that receives ink from an external fluid supply that is mounted on the print cartridge or fluidically connected to the print cartridge by a conduit such as a tube.

While the disclosed embodiments are described in the context of fluid drop jet printing, it should be appreciated that the disclosed structures can be employed in other fluid drop emitting applications including for example delivery of biologically active materials.

Referring to FIG. 2, set forth therein is an unscaled schematic perspective view of an embodiment of an example of the printhead 13 which generally includes a silicon substrate 21 and an integrated circuit thin film stack 25 of thin film layers formed on the silicon substrate 21. The thin film stack 25 implements thin film fluid drop firing heater resistors 56 and associated electrical circuitry such as drive circuits and addressing circuits, and can be formed pursuant to integrated circuit fabrication techniques. By way of illustrative example, the heater resistors 56 are located in columnar arrays along longitudinal ink feed edges 21*a* of the silicon substrate 21.

A fluid barrier layer 27 is disposed over the thin film stack 25, and an orifice or nozzle plate 29 containing the nozzles 17 is in turn laminarly disposed on the fluid barrier layer 27. Bond pads 35 engagable for external electrical connections can be disposed at the ends of the thin film stack 25 and are not covered by the fluid barrier layer 27. The fluid barrier layer 27 is formed, for example, of a dry film that is heated and pressure laminated to the thin film stack 25 and photodefined to form therein fluid chambers 31 and fluid channels 33. By way of illustrative example, the barrier layer material comprises an acrylate based photopolymer dry film such as the Parad brand photopolymer dry film obtainable from E.I. duPont de Nemours and Company of Wilmington, Del. Similar dry films include other duPont products such as the Riston brand dry film and dry films made by other chemical providers. The orifice plate 29 comprises, for example, a planar substrate comprised of a polymer material and in which the orifices 17 are formed by laser ablation, for example as disclosed in commonly assigned U.S. Pat. No. 5,469,199. The orifice plate can also comprise, by way of further example, a plated metal such as nickel.

The fluid chambers 31 in the fluid barrier layer 27 are more particularly disposed over respective heater resistors 56 formed in the thin film stack 25, and each fluid chamber 31 is defined by the edge or wall of a chamber opening formed in the fluid barrier layer 27. The fluid channels 33 are defined by barrier features formed in the barrier layer 27 including barrier peninsulas 37, and are integrally joined to respective fluid chambers 31.

The orifices 17 in the orifice plate 29 are disposed over respective fluid chambers 31, such that a heater resistor 56, an associated fluid chamber 31, and an associated orifice 17 form a drop generator 40. In operation, a selected heater resistor is energized with electric current. The heater resistor produces heat that heats ink liquid in the adjacent ink chamber. When the liquid in the chamber reaches vaporization, a rapidly expanding vapor front or drive bubble forces liquid within the ink chamber through an adjacent orifice. A heater resistor and an associated fluid chamber thus form a bubble generator.

The fluid barrier layer 27 and orifice plate 29 can be implemented as an integral fluid channel and orifice structure, for example as described in U.S. Pat. No. 6,162,589.

Referring to FIG. 3, an embodiment of the thin film stack 25 can more particularly include a heater resistor portion 50 in which the heater resistors 56 are formed. A multi-layer passivation structure 60 disposed on the heater resistor portion 50 can function as a mechanical passivation or protective structure in the ink chambers 31 to absorb the impact of drive bubble collapse, for example. The multi-layer passitvation structure 60 can be disposed directly on the heater resistors or on an intervening chemical/mechanical passivation structure.

The multi-layer structure 60 more particularly includes a bottom layer 60*a* disposed on the heater resistor portion 50, a middle layer 60*b* disposed on the bottom layer 60*a*, and a top layer 60*c* disposed on the middle layer 60*b*. The middle layer 60*b* preferably has a greater yield strength than both of the top and bottom layers. For example, the middle layer 60 has a yield strength that is greater than about 1000 megapascals (MPa), while each of the top and bottom layers 60*c*, 60*a* has a yield strength of less than about 500 MPa.

Each of the top layer 60*c* and the bottom layer 60*a* can comprise a refractory metal such as tungsten (W), molybdenum (Mo), niobium (Nb), and tantalum (Ta). The top layer 60*c* can also comprise a shape memory alloy such as titanium nickel (TiNi).

The middle layer 60*b* can comprise a cobalt based alloy or a nickel based alloy. The middle layer 60*b* can also comprise a carbide such as silicon carbide (SiC), tungsten carbide (WC), a diamond-like carbon (DLC), and a Class IV metal carbide. The middle layer 60*b* can also comprise a nitride such as silicon nitride, cubic boron nitride (CBN), titanium nitride (TiN), tantalum nitride (TaN), zirconium nitride (ZrN), and chromium nitride (CrN).

Other materials that can be used for the middle layer 60*b* include nickel (Ni), titanium (Ti), palladium (Pd), platinum (Pt), a NOREM brand iron based alloy, and a titanium aluminum (TiAl) alloy.

In a specific implementation of the multi-layer structure 60, the top and bottom layers 60*c*, 60*a* comprise tantalum and the middle layer 60*b* comprises silicon carbide. In another specific implementation, the top and bottom layers 60*c*, 60*a* comprise tantalum and the middle layer 60*b* comprises a cobalt based alloy that contains at least 60 wt. % cobalt, such as a cobalt based alloy marketed under the brand name Stellite 6B.

By way of illustrative examples, a top layer 60*c* comprising tantalum can have a thickness in the range of about 200 Angstroms to about 2000 Angstroms, a middle layer 60*b* comprising a cobalt based alloy that contains at least 60 wt. % cobalt can have a thickness in the range of about 1000 Angstroms to about 2000 Angstroms, and a bottom layer 60*a* comprising tantalum can have a thickness in the range of about 1000 Angstroms to about 5000 Angstroms.

The layers of the multi-layer structure 60 can be formed for example by sputtering or other physical vapor deposition techniques, such as ion beam sputtering.

By way of illustrative example, the top layer 60*c* can be an energy absorbing layer and can be sacrificial in the sense that it can be consumed over time. The middle layer 60*b* can be an energy distribution layer that for example spreads out a load of bubble collapse to a larger area of the bottom layer which can be an energy absorbing layer.

The foregoing has thus been a disclosure of a fluid drop emitting device that is useful in ink jet printing as well as other drop emitting applications such as medical devices, and techniques for making such fluid drop emitting device. Also, the disclosed bubble generator structure can be employed in optical switches, acoustic filters, thermal flow regulators, fluidic pumps and valves, flow impedance controllers, MEMs motors, and memories.

Although the foregoing has been a description and illustration of specific embodiments of the invention, various modifications and changes thereto can be made by persons skilled in the art without departing from the scope and spirit of the invention as defined by the following claims.

What is claimed is:

1. A fluid drop emitting apparatus comprising:

a thin film heater resistor portion that includes a plurality of heater resistors;

a fluid barrier layer disposed on the thin film stack;

respective fluid chambers formed in the barrier layer over respective heater resistors;

respective nozzles disposed over respective fluid chambers and heater resistors; and a multi-layer structure underlying the fluid chambers and including a top layer that comprises a refractory metal, a middle layer having a yield strength greater than about 1000 megapascals, and a bottom layer that comprises a refractory metal.

2. The fluid drop emitting apparatus of claim 1 wherein at least one of the top layer and the bottom layer comprises a material selected from the group consisting of tungsten, molybdenum, niobium, and tantalum.

3. The fluid drop emitting apparatus of claim 1 wherein at least one of the top layer and the bottom layer comprises at least one of tungsten, molybdenum, niobium, and tantalum.

4. The fluid drop emitting apparatus of claim 1 wherein at least one of the top layer and the bottom layer comprises tantalum.

5. The fluid drop emitting apparatus of claim 1 wherein the middle layer comprises a carbide.

6. The fluid drop emitting apparatus of claim 1 wherein the middle layer comprises a nitride.

7. The fluid drop emitting apparatus of claim 1 wherein the middle layer comprises a material selected from the group consisting of nickel, titanium, palladium and platinum.

8. The fluid drop emitting apparatus of claim 1 wherein the middle layer comprises at least one of nickel, titanium, palladium and platinum.

9. The fluid drop emitting apparatus of claim 1 wherein the middle layer comprises a material selected from the group consisting of a NOREM brand iron alloy and a titanium aluminum alloy.

10. The fluid drop emitting apparatus of claim 1 wherein the middle layer comprises at least one of a NOREM brand iron alloy and a titanium aluminum alloy.

11. The fluid drop emitting apparatus of claim 1 wherein the middle layer comprises a cobalt based alloy.

12. The fluid drop emitting apparatus of claim 1 wherein the middle layer comprises a nickel based alloy.

13. An ink jet printhead comprising:

a thin film stack that includes a plurality of heater resistors;

a fluid barrier layer disposed on the thin film stack;

respective fluid chambers formed in the fluid barrier layer over respective heater resistors;

respective nozzles disposed over respective fluid chambers and heater resistors; and the thin film stack including a multi-layer structure underlying the fluid chambers and including a top tantalum layer, a middle layer having a yield strength greater than about 1000 megapascals, and a bottom tantalum layer.

14. The ink jet printhead of claim 13 wherein the middle layer comprises a carbide.

15. The ink jet printhead of claim 13 wherein the middle layer comprises a nitride.

16. The ink jet printhead of claim 13 wherein the middle layer comprises a material selected from the group consisting of nickel, titanium, palladium and platinum.

17. The ink jet printhead of claim 13 wherein the middle layer comprises at least one of nickel, titanium, palladium and platinum.

18. The ink jet printhead of claim 13 wherein the middle layer comprises a material selected from the group consisting of a NOREM brand iron alloy and a titanium aluminum alloy.

19. The ink jet printhead of claim 13 wherein the middle layer comprises at least one of a NOREM brand iron alloy and a titanium aluminum alloy.

20. The ink jet printhead of claim 13 wherein the middle layer comprises a cobalt based alloy.

21. The ink jet printhead of claim 13 wherein the middle layer comprises a nickel based alloy.

22. A fluid drop emitting apparatus comprising:

a thin film heater resistor portion that includes a plurality of heater resistors, a fluid barrier layer disposed on the thin film stack;

respective fluid chambers formed in the barrier layer over respective heater resistors;

respective nozzles disposed over respective fluid chambers and heater resistors; and a multi-layer structure underlying the fluid chambers and including a top layer that comprises a refractory metal, a middle layer having a yield strength greater than about 1000 megapascals, and a bottom layer that comprises a refractory metal; wherein the top layer has a thickness in the range of about 200 Angstoms to about 2000 Angstroms;

the middle layer has a thickness in the range of about 1000 Angstroms to about 2000 Angstroms; and the bottom layer has a thickness in the range of about 1000 Angstroms to about 5000 Angstroms.

* * * * *